US007784411B2

(12) United States Patent
Forbes

(10) Patent No.: US 7,784,411 B2
(45) Date of Patent: Aug. 31, 2010

(54) RAIL ROAD CAR BODY STRUCTURE

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 254 days.

(21) Appl. No.: 11/756,102

(22) Filed: May 31, 2007

(65) Prior Publication Data

US 2007/0277696 A1 Dec. 6, 2007

Related U.S. Application Data

(60) Provisional application No. 60/809,340, filed on May 31, 2006.

(51) Int. Cl.
*B61D 17/00* (2006.01)

(52) U.S. Cl. ..... 105/406.1; 105/404; 296/183.1

(58) Field of Classification Search ..... 296/183.1, 296/183.2; 105/406.1, 406.2, 404
See application file for complete search history.

(56) References Cited

U.S. PATENT DOCUMENTS 1,803,449 A * 5/1931 Wine ..... 105/230
2,012,999 A 9/1935 Lamont
2,092,457 A 9/1937 Kiesel, Jr.
2,104,359 A 1/1938 Wine
3,240,168 A * 3/1966 Charles et al. ..... 105/406.1
3,421,453 A 1/1969 Allen et al.
3,713,400 A 1/1973 Teoli
3,844,229 A * 10/1974 Martin ..... 105/248
3,866,545 A 2/1975 Heap
4,236,459 A * 12/1980 Teoli ..... 105/406.1
4,254,714 A * 3/1981 Heap ..... 105/406.1
4,331,083 A * 5/1982 Landregan et al. ..... 105/406.1
4,497,258 A * 2/1985 Ruhmann et al. ..... 105/248
4,498,400 A * 2/1985 Vorwerk et al. ..... 105/248
4,637,320 A * 1/1987 Paton et al. ..... 105/406.1
4,646,653 A 3/1987 Balbi et al.
4,690,071 A * 9/1987 Billingsley et al. ..... 105/404
4,690,072 A * 9/1987 Wille et al. ..... 105/406.1

(Continued)

OTHER PUBLICATIONS

1997 Car and Locomotive Cyclopedia of American Practices, 6th ed., Simmons-Boardman, Omaha, Section 1, "Open Top Hoppers", pp. 46-69.

(Continued)

*Primary Examiner*—S. Joseph Morano
*Assistant Examiner*—Jason C Smith
(74) *Attorney, Agent, or Firm*—Hahn Loeser & Parks, LLP; Michael H. Minns

(57) ABSTRACT

A rail road freight car, which may be a gondola car, may have a flat deck, and a peripheral wall structure. The peripheral wall structure may include arcuate sidewalls and arcuate end-walls. The car body may include internal stiffeners having an arcuate outside sidewall profile. Those stiffeners may be lined up with cross-bearers and bolsters, such that large spring-like frames are formed. The car may include stations at which there are cross-bearers, but no corresponding upstanding wall reinforcement posts mounted outside the car walls. The end top chords may be curved and may be pin jointedly connected to the side top chords. The side top chords may have a central portion that has a substantially greater second moment of area for resisting lateral deflections than adjacent end portions. The arcuate form of the endwalls may provide additional space in which to mount safety appliances.

33 Claims, 11 Drawing Sheets

U.S. PATENT DOCUMENTS 4,738,203 A * 4/1988 Gielow et al. ..... 105/1.1
4,840,127 A 6/1989 Tomaka
4,898,101 A * 2/1990 Harter ..... 105/247
5,070,793 A 12/1991 Kurtz et al.
5,335,603 A 8/1994 Wirick
5,373,792 A * 12/1994 Pileggi et al. ..... 105/406.1
5,727,475 A 3/1998 Kurtz
6,138,581 A * 10/2000 Smith et al. ..... 105/406.1
6,164,210 A * 12/2000 Coslovi et al. ..... 105/396
6,601,522 B2 8/2003 Roxby
6,865,992 B1 * 3/2005 Fetterman et al. ..... 105/247
6,877,440 B1 * 4/2005 Kilian et al. ..... 105/406.1
7,434,519 B2 * 10/2008 Forbes et al. ..... 105/406.1
7,461,600 B2 * 12/2008 Forbes et al. ..... 105/406.1
2007/0101895 A1 * 5/2007 Forbes et al. ..... 105/406.1
2007/0101896 A1 * 5/2007 Forbes et al. ..... 105/406.1
2007/0277696 A1 * 12/2007 Forbes ..... 105/406.1
2008/0127854 A1 * 6/2008 Forbes et al. ..... 105/247

OTHER PUBLICATIONS

1997 Car and Locomotive Cyclopedia of American Practices, 6th ed., Simmons-Boardman, Omaha, Section 1, "Gondolas", pp. 74-93.

* cited by examiner

RAIL ROAD CAR BODY STRUCTURE

This Application claims the benefit of the priority of U.S. Provisional Patent Application No. 60/809,340, entitled Rail Road Car Body Structure, and filed May 31, 2006. The subject matter of U.S. Provisional Patent Application 60/809,340 is incorporated herein by reference.

FIELD OF THE INVENTION

This invention relates to the field of rail road freight cars, and, in particular to rail road freight cars such as may employ a body structure for containing lading.

BACKGROUND

There are many kinds of rail road cars for carrying particulate material, be it sand or gravel aggregate, plastic pellets, grains, ores, potash, coal or other granular materials. These materials are not liquid, yet may in some ways tend to flow in a quasi liquid-like manner under the influence of gravity. Many of those cars have an upper opening, or accessway of some kind, by which the particulate is loaded, and a lower opening, or accessway, or gate, by which the particulate material exists the car under the influence of gravity. Others such as rotary dump gondola cars, may be unloaded by use of a rotary dumping system in which the entire railroad car is inverted such that the lading may be dumped out while the car is upside down.

In general, design of cars of this nature tends to involve a balancing of a need to reduce car weight to permit a greater mass of lading to be carried, and a need for relative simplicity of construction with a desire for robustness and long service life.

SUMMARY OF THE INVENTION

In an aspect of the invention, there is a rail road car. The car has a containment structure mounted on railroad car trucks. The containment structure includes a peripheral wall defining an accommodation for lading therewithin. The containment structure includes a bottom portion and peripheral wall panels mounted thereabout and standing upwardly thereof. The peripheral wall panels include sidewall portions running lengthwise along the bottom portion. The sidewall portions include at least one sidewall member having a lower portion meeting the bottom portion at a junction, and an upper portion upwardly distant from the bottom portion. The upper portion has a margin more laterally inboard than the junction.

In a feature of that aspect of the invention the rail road car is a rotary dump gondola car. In another feature the rail road car is a gondola car, the bottom portion of the containment structure includes a deck plate, and the lower portion of the sidewall member mates substantially perpendicularly with the deck plate. In a further feature the rail road car is a gondola car, the bottom portion of the railroad car is a deck plate, and the lower portion of the sidewall member mates with the deck plate at an angle lying in the range of 75 degrees to 90 degrees. In a narrower expression of that feature, the angle lies in the range of 80 to 90 degrees. In a still narrower expression of that feature, the angle lies in the range of 85 to 90 degrees.

In another feature the sidewall member has a location of maximum car width at a height $H_1$. The sidewall has an overall height measured upwardly from the deck $H_2$. $H_1$ is less than one third of $H_2$. In still another feature the sidewall member is part of a convergent wall section. The sidewall tends generally to narrow from a wider base to a narrower upper margin. The sidewall has an arcuate portion. The sidewall is more nearly perpendicular to the bottom portion at the junction than at the upper margin.

In yet another feature the sidewall has a maximum car width at the bottom portion, and narrows progressively toward the upper margin. In still yet another feature the car has a top chord extending along the upper margin of the sidewall member. The top chord being located outboard of the margin, and the top chord extends laterally outboard a distance D corresponding substantially to that of the sidewall portion at the junction. In still a further feature wherein D lies at most equally as far laterally outboard as the sidewall member at the junction.

In a further feature the sidewall member has its widest point at its lower margin. In yet a further feature the sidewall member has an arcuate portion that increasingly inwardly angled as a function of upward height from the bottom portion. In another aspect the arcuate portion forms the majority of the sidewall member. In yet another aspect of that feature the sidewall member has a lower margin and has a thickened member running along the lower margin. In still a another aspect of that feature the sidewalls portions are curved on a concave curve, and the peripheral wall includes curved endwall members.

In yet still another aspect of that feature at least one of the endwall members is formed on a cylindrical section that has a vertical axis. In further aspect of that feature at least one of the curved sidewall members and at least one of the curved endwall members intersect at a common locus of intersection. In yet a further aspect of that feature the sidewall member has a sidewall top chord running therealong. The endwall members have endwall top chord members running therealong. At least one of the sidewall top chord members and at least one of the endwall top chord members are joined at a pin-jointed connection.

In another feature the bottom portion of the containment structure includes a floor plate. The floor plate extends longitudinally proud of at least a portion of one of the endwall members in a transversely outboard region thereof. In still another feature a ladder is mounted to a corner region of the floor plate lying outboard of the peripheral wall.

In another aspect of the invention, there is a rail road gondola car that has a containment wall structure. The containment wall structure defines an accommodation for lading. The containment wall structure is mounted upon railroad car trucks for rolling motion along rail road tracks. The containment wall structure includes a bottom portion and an upstanding sidewall portion. The sidewall portion includes at least one endwall portion. The endwall portion is formed on a longitudinally bulging profile. In another feature a predominant portion of the endwall portion is formed on an arc. In still another feature the endwall includes a cylindrical portion. The cylindrical portion has a substantially vertical axis. In yet another feature the cylindrical portion is formed on a circular arc.

In yet another aspect of the invention, there is a rail road gondola car that has a containment structure mounted upon rail road car trucks for rolling motion along rail road car tracks. Each truck has a truck bolster extending cross-wise between a pair of sideframes, and wheelsets mounted in the sideframes. Each wheelset has an axle and a pair of first and second wheels mounted at either end thereof. The containment structure includes a bottom portion and upstanding sidewall portions. The bottom portion has at least one body bolster mounted cross-wise thereunder. The body bolster is pivotally mounted on the truck bolster. The wall structure has a reinforcement that extends partially cross-wise therewithin abreast of one of the body bolsters. The reinforcement extends laterally inboard of one of the wheels of the truck.

In a further aspect of the invention, there is a rail road gondola car. The gondola car has a predominantly flat deck and a peripheral wall structure that stands upwardly thereof and has an accommodation for lading defined therewithin. The peripheral wall structure includes at least one sidewall portion that has an arcuate profile.

In yet a further feature of that aspect, the arcuate sidewall portion has a region mated to the deck at a welded junction. The junction is protected by a shroud. The rail road gondola car has arcuate endwall sheets. The railroad gondola car has endwall top chords. The endwall top chords have a bulging arcuate form when viewed from above. In still a further feature of the invention, the rail road car has sidewalls and sidewalls top chords mounted thereto. The endwall top chords are connected to the sidewalls top chords at a pin joint connection In yet still a further aspect of the invention, there is a rail road gondola freight car. The car has sidewalls that include portions that have an arcuate profile when viewed in cross-section. The sidewalls have clamp fittings. The clamp fittings permit the rail road car to be inverted for dumping of lading from the gondola car.

In still another aspect of the invention, there is a rail road gondola car that has curved sidewalls. The gondola car has a predominantly flat floor. The gondola car has cross-bearers that support at least a portion of the floor. The gondola car is free of an upwardly extending posts abreast of at least one of the cross-bearers.

In a further feature of the invention a majority of the cross-bearers are mounted at longitudinal stations of the gondola car that are free of upstanding sidewall reinforcement posts. In another feature of the invention, the car is free of external sidewalls support posts abreast of the cross-bearers. In yet another feature of the invention, there is provided a rail road gondola car. The gondola car has a peripheral wall that defines an accommodation in which to transport lading. The peripheral wall includes sidewalls portions and endwall portions. The first of the sidewalls has a cross-sectional profile that is predominantly arcuate. The first of the endwalls is arcuately formed. The first endwall mates with the first sidewalls.

In a further feature of the invention, there is rail road gondola car. The gondola car has a lading containment structure carried upon railroad car trucks for rolling motion along rail road tracks. The gondola car has bolsters mounted cross-wise above the trucks. The bolsters have a central upstanding web running lengthwise therealong. In yet still a further feature the containment structure includes a peripheral wall. The containment structure further includes a wall reinforcement web mounted in alignment with the central upstanding web of the bolster. In a yet still a further feature of the invention the containment structure includes a peripheral wall. The peripheral wall includes sidewalls. One of the sidewalls has a profile, when viewed in cross-section, that is arcuate.

In another aspect of the invention there is a rail road gondola car having a peripheral wall structure defining a containment vessel for lading. The wall structure includes side beams running along opposite sides of the car, each of the side beams having a top chord. At least one of the top chords has a first region and a second region. The first region has a first second moment of area for resisting vertical bending, Z1, and a first second moment of area for resisting sideways deflection Y1. The top chord also has a second region, the second region having a second second moment of area for resisting vertical bending, Z2, and a second second moment of area for resisting sideways deflection, Y2. The first region is locally reinforced such that a ratio of Z1/Z2 is greater than a ratio of Y1/Y2.

In still another aspect of the invention there is a railroad gondola car having a lading containment structure mounted upon trucks for rolling along railroad tracks. The containment structure includes a deck sheet and a pair of opposed upstanding sidewalls running along the car. The deck sheet has bolsters and cross-bearers extending cross-wise thereunder. The sidewalls have an inwardly concave portion. The deck sheet defines an upper flange of the cross-bearers and bolsters, and a predominantly horizontally extending bottom flange of the sidewalls.

In a feature of that aspect, the car further includes a lengthwise running center sill, and the deck sheet forms a top cover of the center sill. In another feature, the containment structure includes cross-wise extending reinforcement members mounted to the deck sheet at lengthwise intermediate locations, the cross-wise reinforcements being mounted upon the deck sheet. In still another feature the trucks have wheels, the reinforcements are channels, and the deck sheet has accommodations formed therein beneath the reinforcements, the accommodations being formed at locations above the wheels of the trucks.

These and other aspects and features of the invention may be understood with reference to the description which follows, and with the aid of the illustrations of a number of examples.

BRIEF DESCRIPTION OF THE FIGURES

The description is accompanied by a set of Figures that are provided by way of illustration and not of limitation of an example of an embodiment of aspects and features of the invention, and in which.

DETAILED DESCRIPTION

Figure 1A:
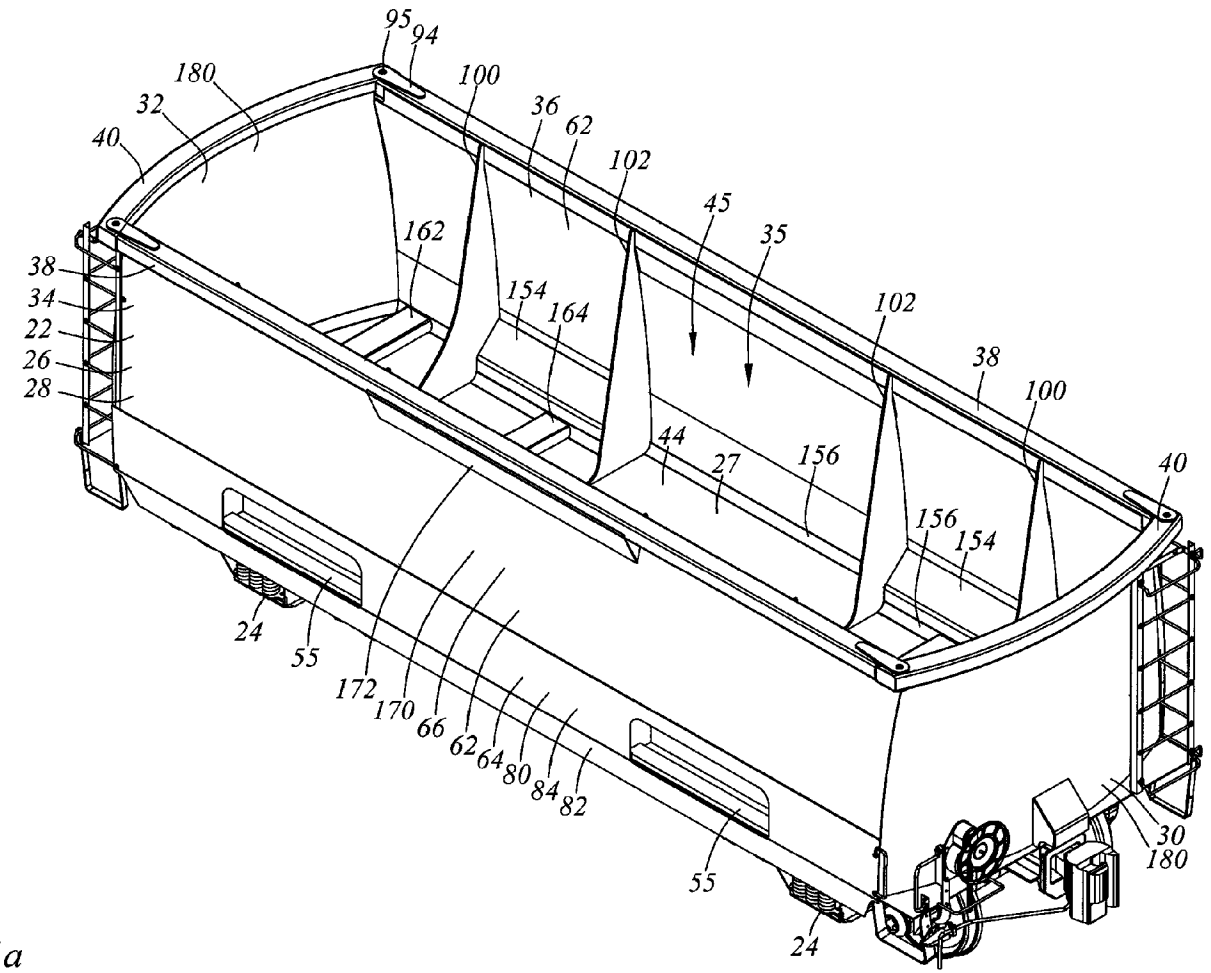
FIG. 1*a* is a general arrangement, isometric view of a rail road freight car from one corner and above.
Figure 1B:
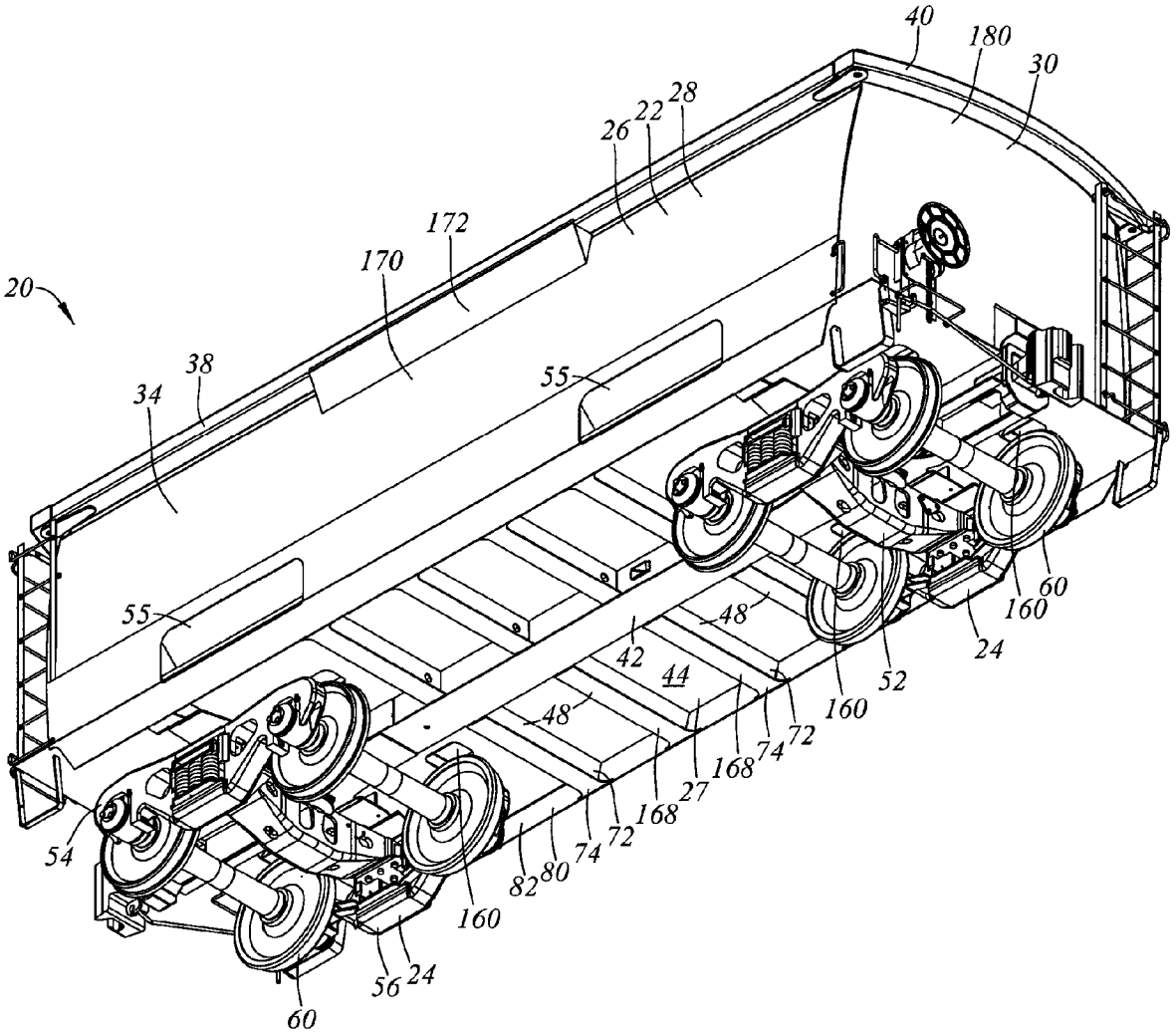
FIG. 1*b* is an isometric view of the railroad freight car of FIG. 1*a*, taken from an opposite corner and below.
Figure 1C:
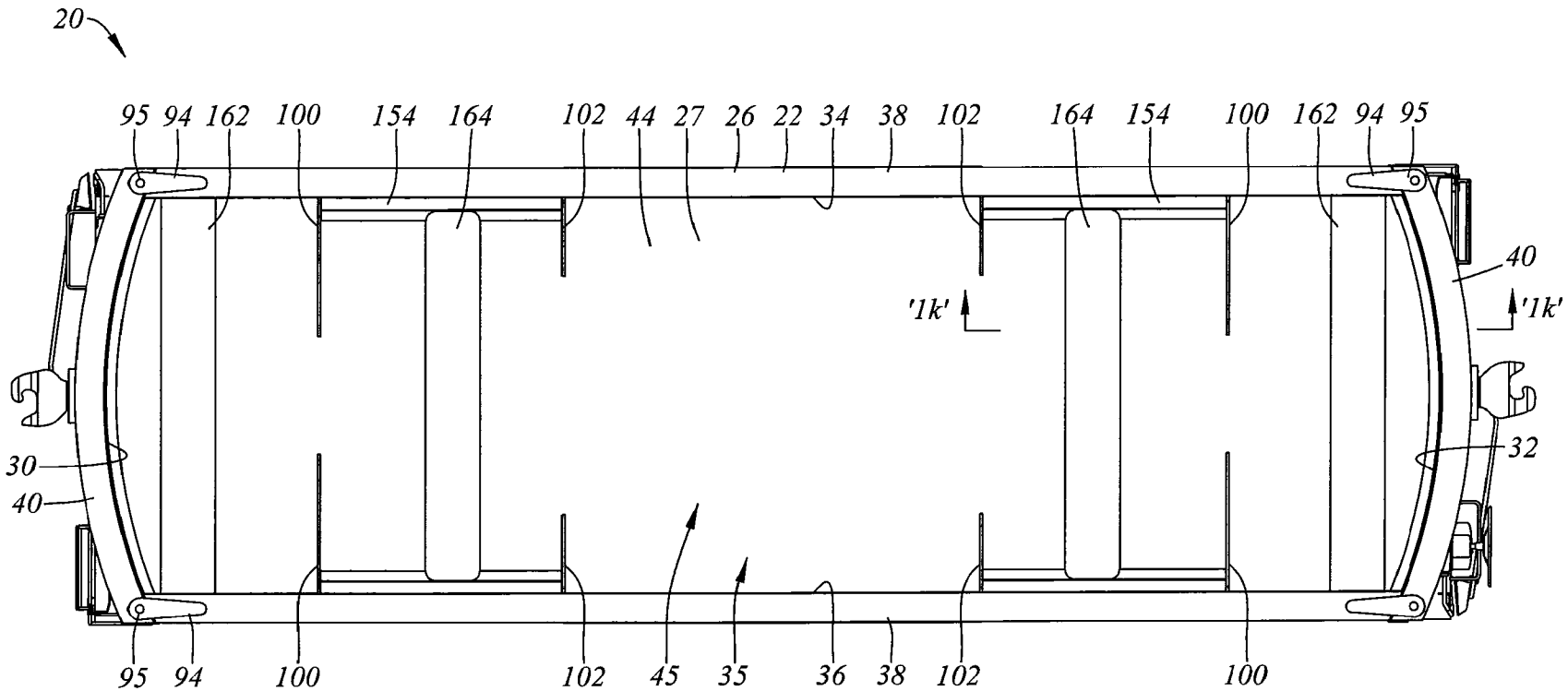
FIG. 1*c* is a top view of the rail road freight car of FIG. 1*a;*
Figure 1D:
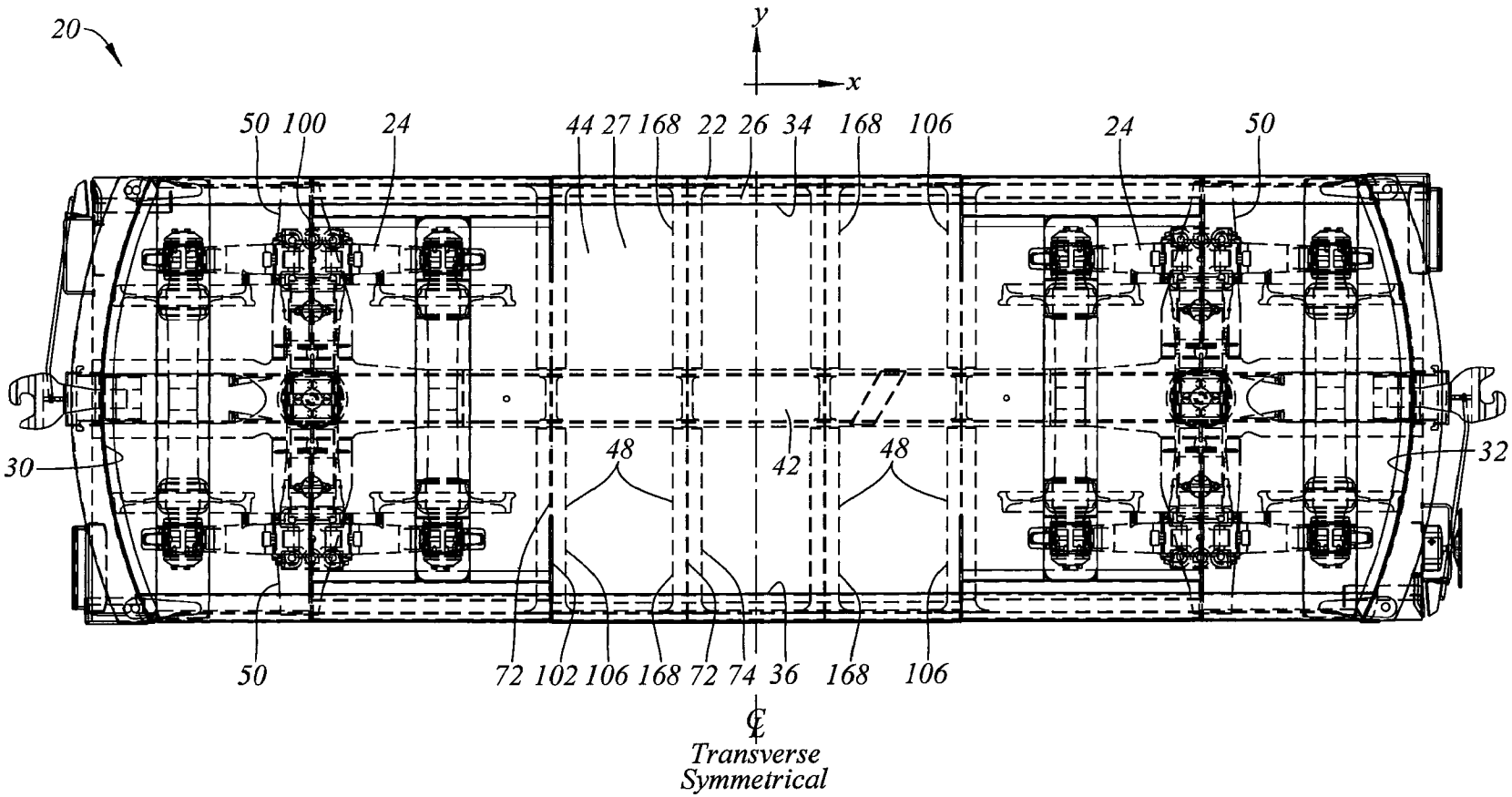
FIG. 1*d* is another top view of the rail road car of FIG. 1*c*, with the underframe and other hidden features shown.
Figure 1E:
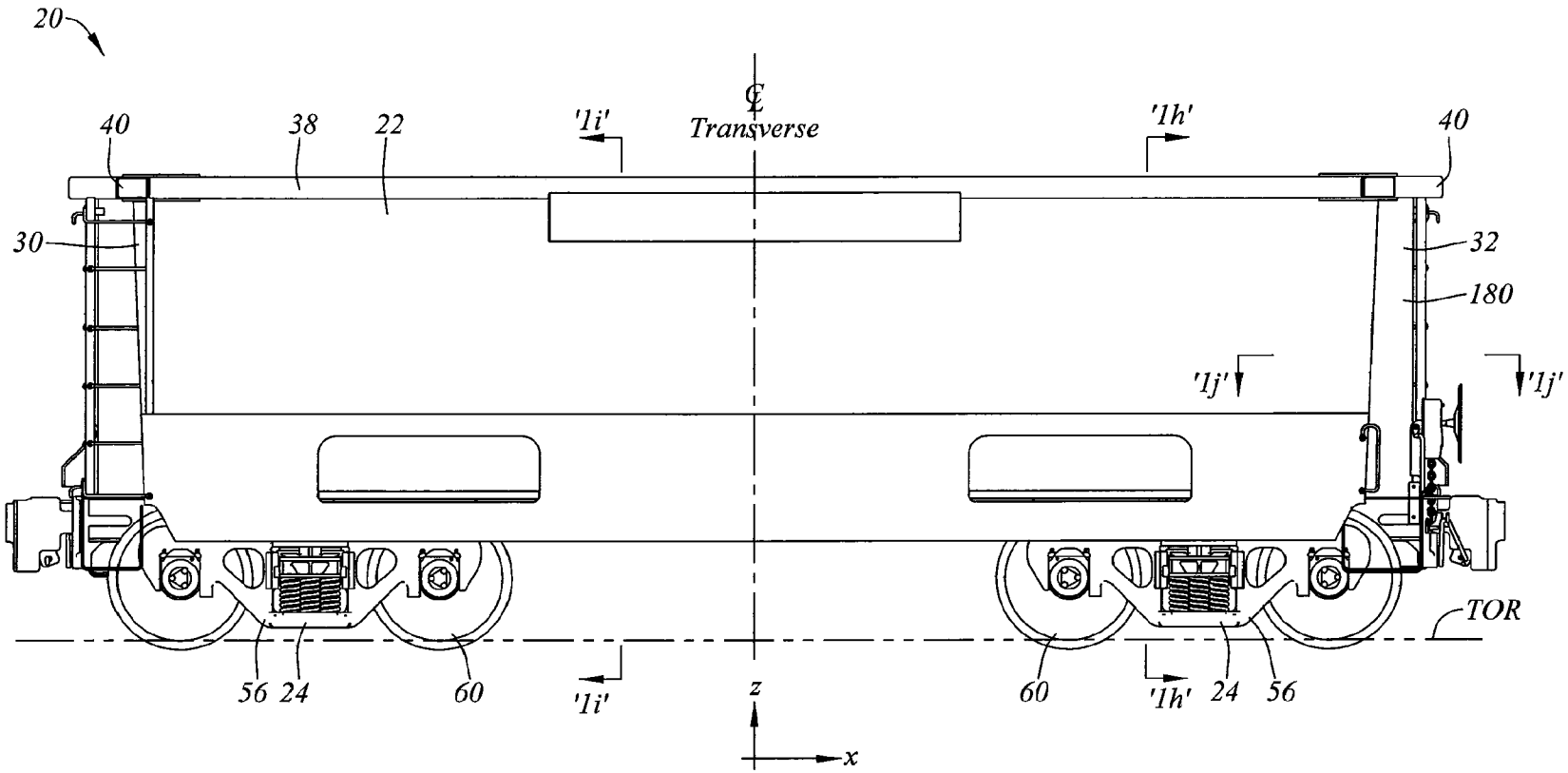
FIG. 1*e* is a side view of the rail road freight car of FIG. 1*a;*
Figure 1F:
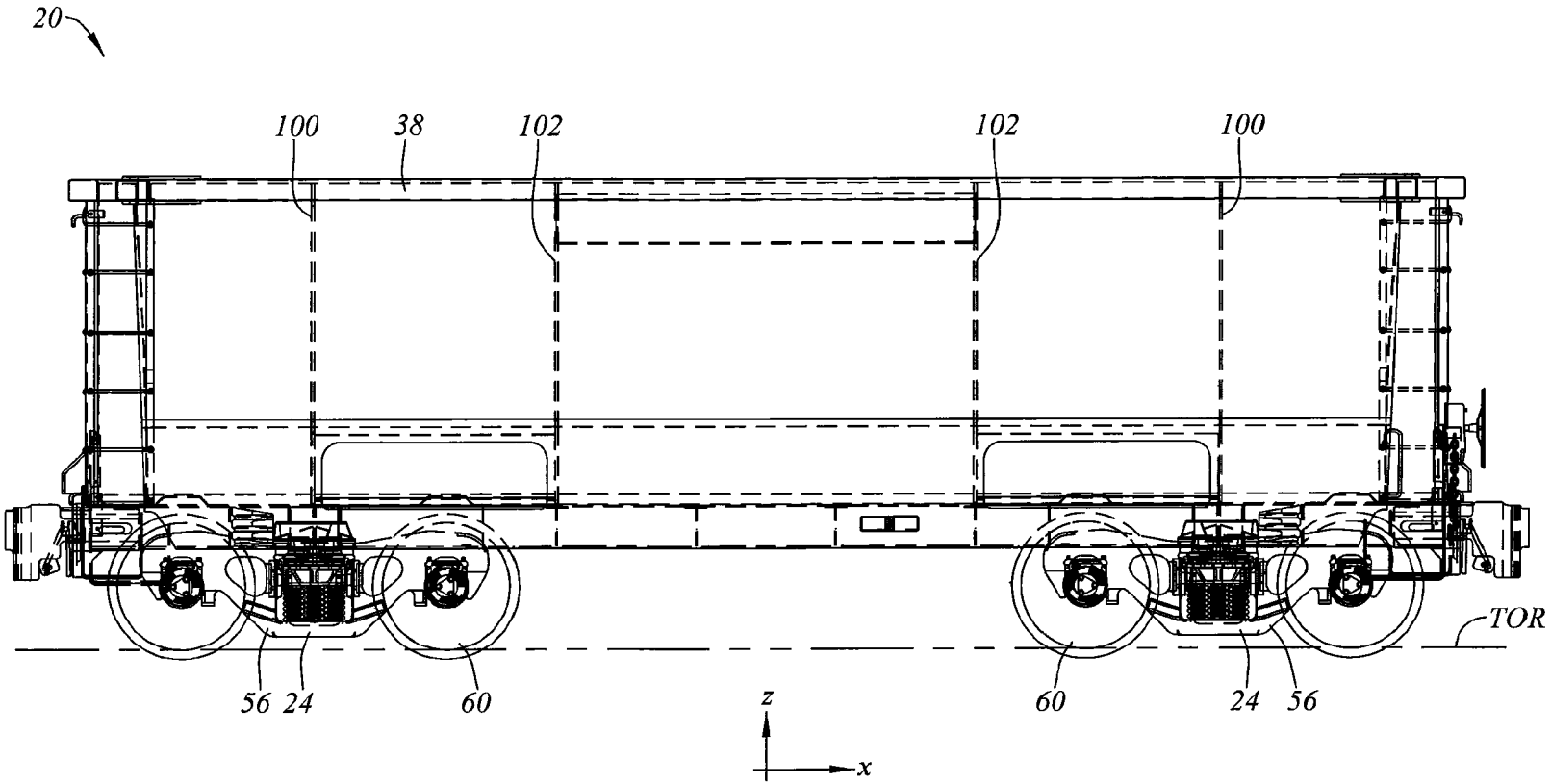
FIG. 1*f* is another side view of the railroad car of FIG. 1*d*, with hidden structure shown.
Figure 1G:
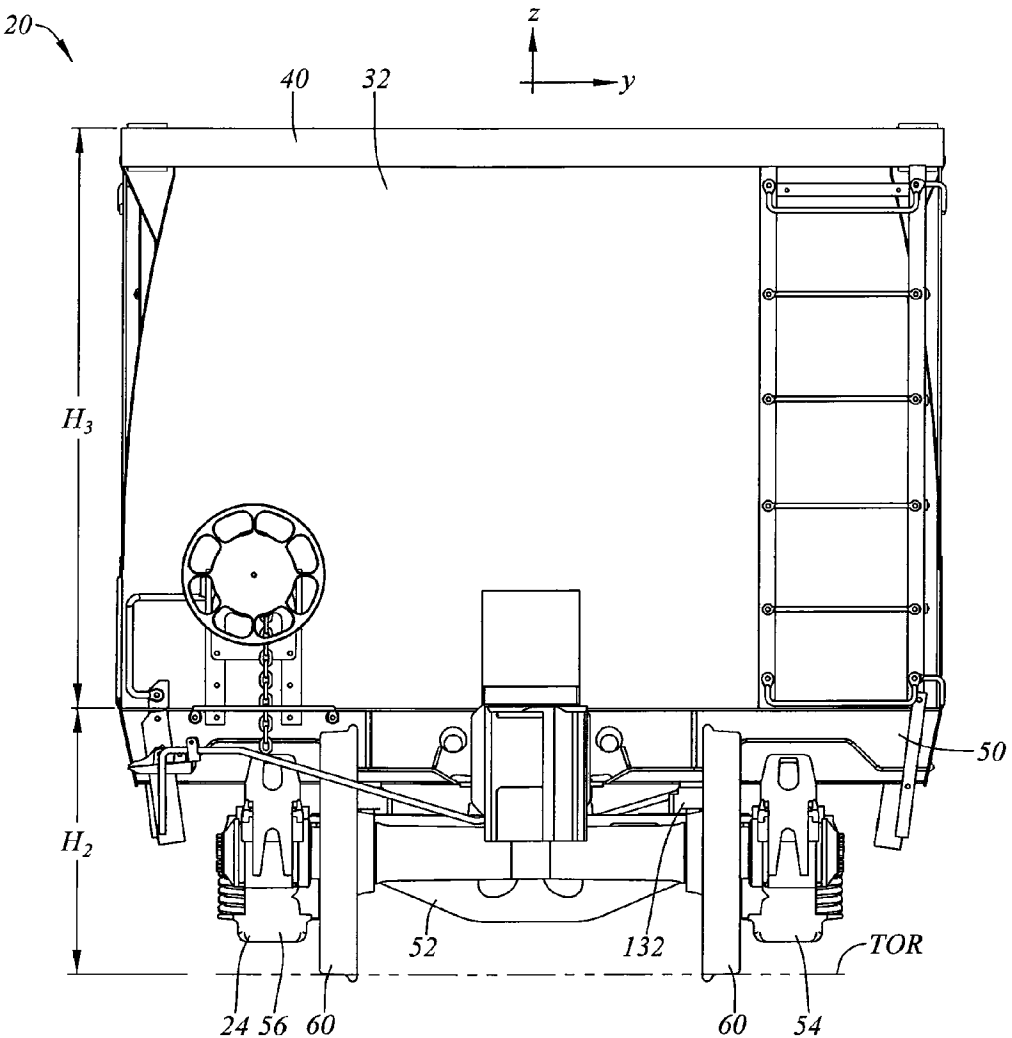
FIG. 1*g* is an end view of the rail road freight car of FIG. 1*a;*
Figure 1H:
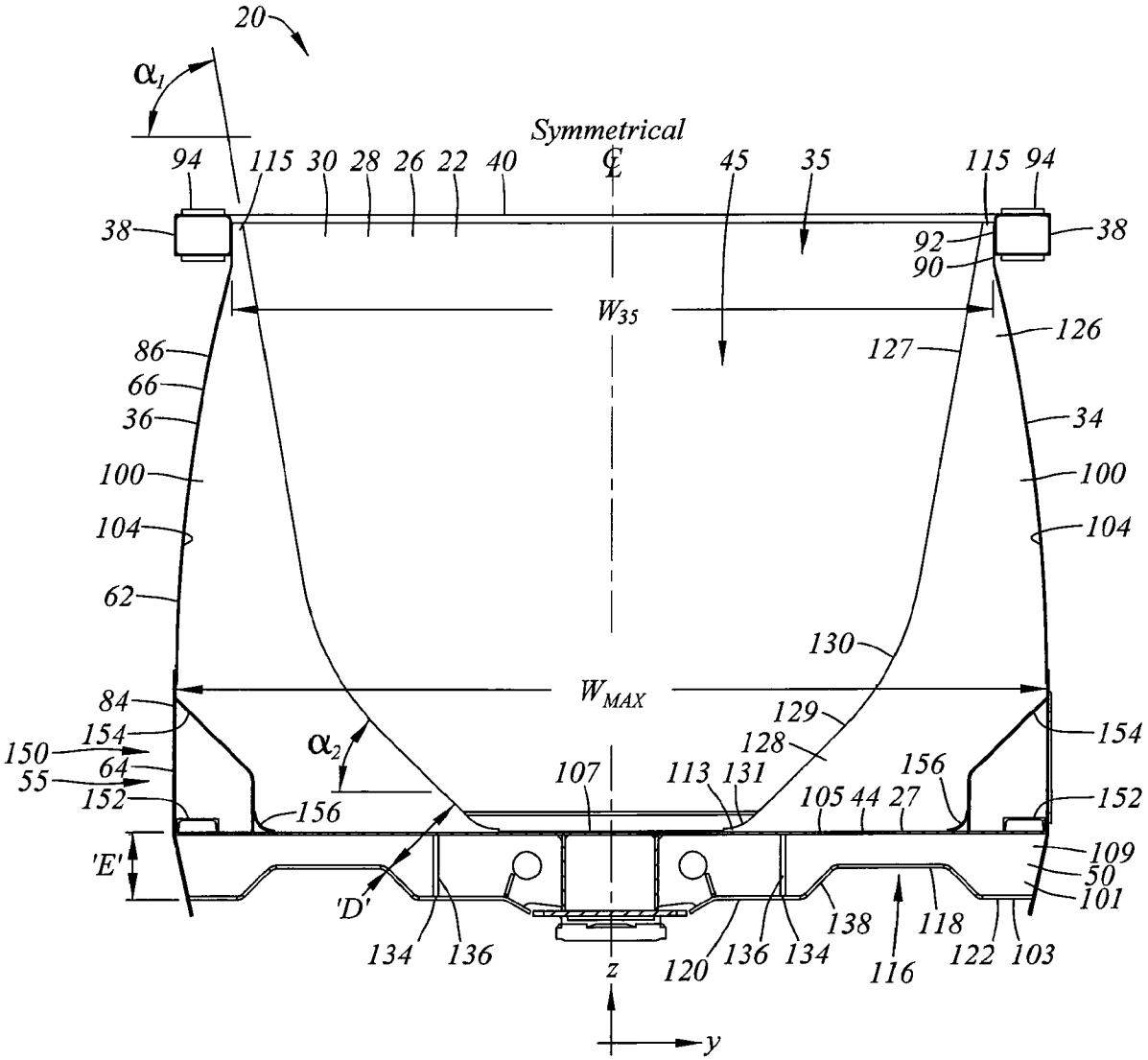
FIG. 1*h* is lateral cross-section of the rail road freight car of FIG. 1*a*, taken on section '1*h*-1*h*' of FIG. 1*e*, looking longitudinally outboard facing the main bolster.
Figure 1I:
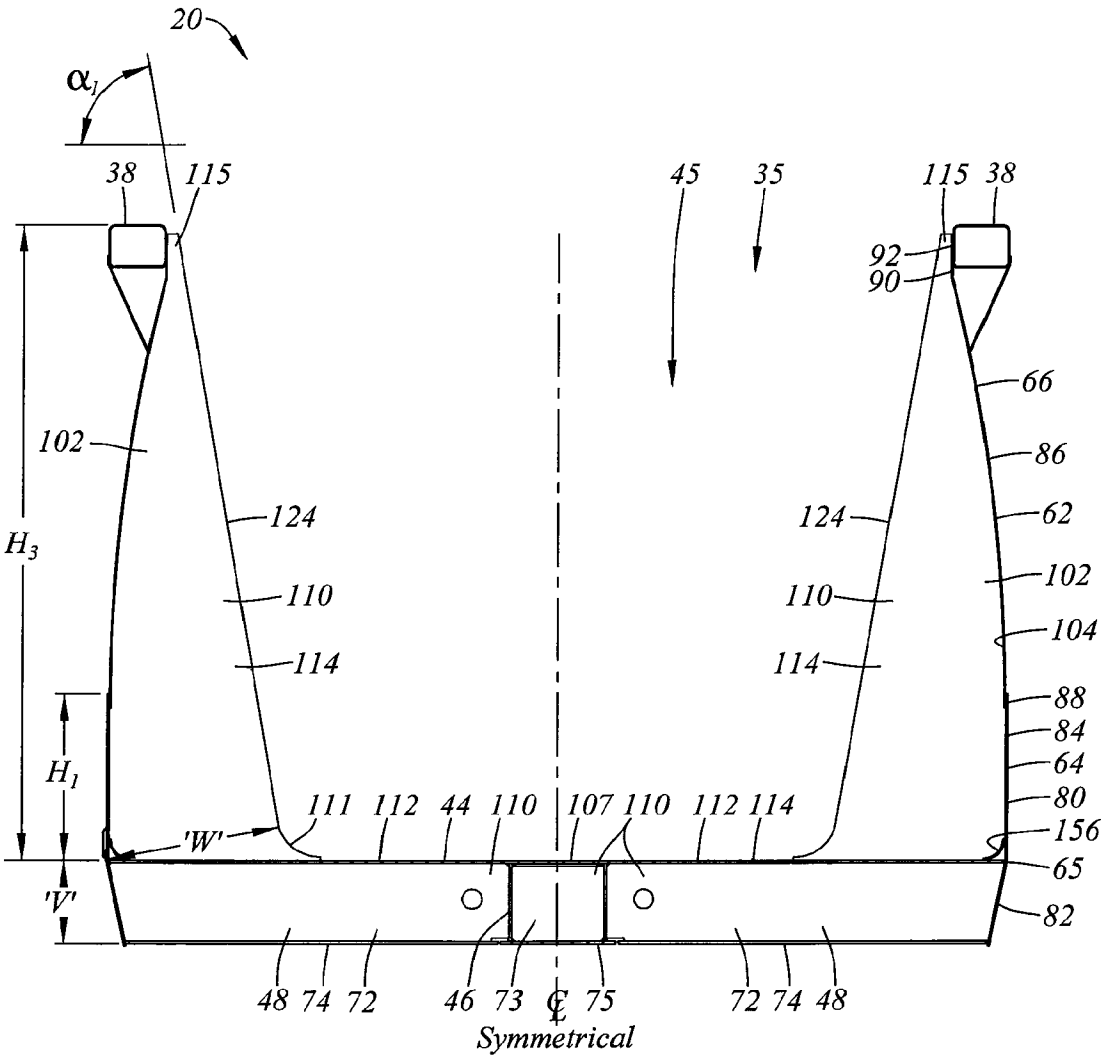
FIG. 1*i* is lateral cross-section of the rail road freight car of FIG. 1*a*, taken on section '1*f*-1*f*' of FIG. 1*e*, looking longitudinally outboard facing a cross-bearer longitudinally inboard of the main bolster.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the rail road car described herein, the longitudinal direction or x-axis is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, z-axis, or upward and downward, are terms that use top of rail, TOR, as a datum. In the context of the car as a whole, the term lateral, or laterally outboard, or transverse, or transversely outboard refer to a distance or orientation in the y-axis direction measured from the longitudinal centerline of the railroad car, or car unit, or of the centerline of the centerplate. The term "longitudinally inboard", or "longitudinally outboard" is a distance taken relative to a mid-span lateral section of the car, or car unit. Pitching motion is angular motion of a railcar unit about a horizontal axis (i.e., the y-axis) perpendicular to the longitudinal direction. Yawing is angular motion about a vertical or z-axis. Roll is angular motion about the longitudinal or x-axis. Given that the rail road car described herein may tend to have both longitudinal and transverse axes of symmetry, a description of one half of the car may generally also be intended to describe the other half as well, allowing for differences between right hand and left hand parts. Unless otherwise noted, it may be assumed that the structural components of railroad cars described herein are made of steel, most typically a mild steel having a yield strength of 50 kpsi, although other materials, such as aluminum or reinforced composite materials might be used in some instances.

This specification is to be understood in the context of the North American railroad industry. Terms used in this specification are to be given their customary and ordinary meanings as understood by persons of ordinary skill in the railroad industry. In that regard, following from *Phillips* v. *AWH Corp.,* 415 F.3d 1303, 75 U.S.P.Q.2d 1321 (Fed. Cir. 2005), the specification and claims are to be understood in context, and are not to be interpreted according to general dictionary definitions. In this context, *Railway Age's Comprehensive Railroad Dictionary* (© 1984 Simmons-Boardman, Omaha) may provide definitions of rail road terms that are not inconsistent with this specification. The Applicant explicitly excludes interpretations made by any Examiner in the US Patent Office, or in any other Patent Office, other than those interpretations supported by the wording and context of this specification, unless those interpretations are shown to have been used in a manner that (a) is not inconsistent with this specification; and (b) is supported either (i) by objective evidence of record in the form of at least two independent examples of pre-existing railroad literature written by persons engaged in, and having knowledge of, the railroad industry in North America, Britain, or former British empire or commonwealth countries, or (ii) by the testimony, which may be by way of affidavit or declaration, of a non-PTO-employed person of at least ordinary skill in the art and having not less than 10 years experience in the North American railroad industry.

FIG. 1*a* shows an isometric view of an example of a rail road freight car 20 that is intended to be representative of a wide range of rail road cars in which the present invention may be incorporated. While car 20 may be suitable for a variety of general purpose uses, it may be taken as being symbolic, and in some ways a generic example of, a gondola car, in which lading is introduced by gravity flow from above, and removed either by a bucket loader from above, or by gravity discharge when the car is engaged and inverted by, for example, a rotary dumping machine. Gondola cars may come in many different types, whether potash cars, ore cars, coal cars and so on. In one embodiment car 20 may be a gondola car such as may be used for the carriage of bulk commodities in the form of a granular particulate, such as ballast, be it in the nature of relatively coarse gravel or fine aggregate in the nature of fine gravel or sand, coal, ores in the form of pellets or concentrate, and so on. Car 20 may be symmetrical about both its longitudinal and transverse, or lateral, centreline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at articulated connectors, or by draw bars. Car body 22 may include a lading containment vessel or shell or structure 26 such as may include a bottom portion 27, that may be a floor, or deck, whether having outflow gates or not; and an upstanding wall structure 28 standing upwardly therefrom, which may include a pair of opposed first and second endwalls 30, 32, that extend predominantly cross-wise, and a pair of first and second sidewalls 34, 36 that extend lengthwise, the endwalls 30, 32 and sidewalls 34, 36 co-operating to define a generally rectangular form of peripheral wall structure 28. Wall structure 28 may include top chords 38 running along the top of sidewalls 34, 36, and top chords 40 running atop endwalls 30, 32. Those top chords may tend to be connected at the corners, or points, of the car body and may form a frame or rim, or lip, at the top of the car body sidewalls.

In some instances car 20 may have stub center sills at either end, in which case sidewalls 34, 36 may act as deep beams, and may provide the primary load path by which to carry vertical loads to the main bolsters that extend laterally from the centerplates. Alternatively, or in addition to, deep side beams, car 20 may include a center sill 42, which may be a straight-through center sill, running from one end of the car body to the other. In the case of a single, stand alone car unit, draft gear and releaseable couplers may be mounted at either end of the center sill. In a gondola car the upper portion of the car may typically include an opening 35 defined between the top chord members 38 and 40, through which lading may be introduced, or extracted or emptied, as may be. The endwall and sidewalls members of containment structure 26 may define a peripheral wall structure bounding an at least partially enclosed space, volume, receptacle, bin, hopper, catchment, box, tub or accommodation 45, however the space inside the gondola body for receiving and containing lading may be termed.

Bottom portion 27 may include a floor panel, or sheet, or deck 44. The floor panel, or deck 44, may have lateral supports or reinforcements mounted thereunder, such as cross-bearers 48 and body bolsters 50. The body bolsters may be pivotally mounted to trucks 24, such as to permit relative angular displacement about a vertical axis, a conventional method being to provide a center plate to the body bolster for seating in a center plate bowl of a truck bolster. Where car 20 is intended for use as a rotary dump car, the car body may also include manipulation or lifting fittings, indicated generally as 55, by which the car may be engaged by a rotary dumping apparatus, crane, jig, clamp, or the like for the purpose of holding the car while it is flipped and emptied.

Trucks 24 may, most typically, include a laterally extending truck bolster 52 such as may extend cross-wise between a pair of first and second sideframes 54, 56, the ends of the truck bolster being resiliently mounted on spring groups in the sideframe windows. The sideframes are mounted on wheelsets 58, each of which has an axle and a pair of first and second wheels 60. Most conventionally, wheels 60 sit laterally inboard of sideframes 54, 56.

Car 20 may be a car for transporting particulate material, such as ores. In one embodiment, car 20 may have 38 inch wheels, and may have a rated carrying capacity of 315,000 lbs., gross weight on rail (GWR), such as is nominally referred to as a '125 Ton' car in AAR terminology. In other embodiments it may be a car having 33 or 36 inch wheels, and may have a rated load capacity of 70 Tons (220,000 lbs GWR), 100 Tons (263,000 lbs GWR), or 110 tons (286,000 lbs., GWR) It may be, for example, that car 20 is an iron ore carrying car, and it may have an abnormally short truck center distance. (That is, the regular truck center distance may be considered to be 46'-3", cars having truck centers of greater pitch spacing being required to be narrower to allow for swing out. A car having a truck center spacing of less than 46'-3" may be considered to have short truck spacing). It may also be that such a car may be built to fall within the Association of American Railroads (AAR) Plate B, and may have a maximum width of about, but not more than, 128 inches.

Car 20 may have sidewalls, or sidewall portions 62, that are curved such that they are inwardly concave and outwardly bulging, or convex (i.e., a straight line chord drawn from the extremities of the curved portions will lie inside rather than outside the containment vessel). In one embodiment, sidewalls portion 62 may run substantially the entire length of the car from endwall 30 to endwall 32. Sidewall portion 62 may extend from a lower portion 64 that may run outboard of, and be connected along the outboard margin of, the floor plate (i.e., deck 44), to an upper portion 66, to which the respective top chord member 38 may run. It may be that the overall width of the accommodation, as measured over the outside width of sidewall portion 62, may vary with height relative to deck 44 (or, indeed, with respect to top of rail). It may be that deck 44 is supported by cross members, such as cross-bearers 48, that have at least one substantially vertically standing, laterally running, web 72, and a predominantly horizontally extending, laterally running bottom flange 74. Lower portion 64 may extend downwardly to, and past, the floor sheet (deck 44), to which it may be connected both above and below by fillet welds, to overlie, cover, and be connected to, the abutting ends of web 72 and flange 74 of the cross-bearers, and to the corresponding webs and flanges of the bolsters. Center sill 42 may include internal web separators 73 that provide shear web continuity between left and right hand webs 72 of cross-bearers 48, while center sill bottom cover plate 75 provides flange continuity between left and right hand flanges 74 of cross-bearers 48. In one embodiment, the floor plate of the containment vessel defined by the upstanding peripheral walls, namely deck sheet 44, may be a substantially continuous sheet that may run from side to side, and may run from end to end, of the car body, and may form the top cover plate of the center sill, the upper flange of the cross-bearers, the upper flange of the bolsters, and may form or function as the bottom or horizontal flange of the side beam or sidewall assembly.

Although car 20 may not have a side sill, as such, the region of the junction 65 of the lower portion 64 of sidewalls portion 62 with the deck sheet 44, may tend to yield a stiffened structural section that may tend to function somewhat in the manner of a side sill, by which the side beam of the car defined by the sidewalls and the top chords is given a structure that may tend to function as a bottom flange. The predominantly upwardly standing portion of sidewall portion 64 extending upward of deck 44 may tend to mate with the floor sheet at an angle that is substantially a right angle. To the extent that lower portion 64 may be somewhat arcuate, and the point of greatest width may not necessarily be at floor level, (or, expressed alternately, the center of curvature of the section may not lie in the plane of deck sheet 44, but may lie above or below that level) the angle at which the floor sheet and the sidewall sheet meet may not be precisely 90 degrees. In one embodiment that angle lies in the range of 75 to 90 degrees. In a narrower range, it may lie in the range of 80 to 90 degrees, and, in a still narrower range, it may lie in the range of 85 to 90 degrees.

Commencing below deck level, the sidewall, or sidewall portion 62, may include a lower margin or lower region that may include a length-wise running skirt, or plate or sheet 80. Sheet 80 may have a lower portion 82 and an upper portion 84. Lower portion 82 may lie along, and be welded across the ends of, the various cross-bearers 48 and bolsters 50. Lower portion 82 and upper portion 84 may meet at a lengthwise running slope discontinuity, which may either be a longitudinal butt, fillet or bevel weld, or a bend formed in a single monolithic sheet. In either case, the lower and upper portions are welded to the outboard peripheral edge of the deck sheet 44, and tend to form a generally T-shaped section, in which the influence of the members may tend to stiffen each other. The zone of influence may tend to extend 20 to 30 times the thickness of the member away from the joint. Upper portion 84 may act as the upwardly extending leg of a fabricated angle iron, while the deck sheet 44 acts as a horizontal leg. Upper portion 84 may be arcuate, or may be predominantly planar, and may stand in a vertical, or substantially vertical plane, or may have a lower portion adjoining deck sheet 44 that is substantially planar, and an upper portion that is bent inward, such as on a continuous arc that may extend to an upper margin at or near the top chord.

In one embodiment, upper portion 84 may extend upwardly and seamlessly all the way to top chord 40. In another embodiment, there may be a transition to an upper wall plate, or sheet 86. Sheet 86 may be joined to sheet 80 along a lap joint 88 as indicated, or by other means such as to form a longitudinal seam or join. Sheet 86 may be of a different thickness from sheet 80, and may be thinner than sheet 80. For example, deck sheet 44 may be made of, for example, plate, which may be steel plate, in the range of ¼" to ½" thick, and may in one embodiment be about ⅜" thick. Sheet 86 may be in the range of 0.1" to 5/16" thick, and in one embodiment may be about ⅛" to 3/16" thick. Sheet 80 may be in the range of about ¼ to ⅝" thick. In one embodiment it may be in the range of 5/16" to ½" thick, and may be about ⅜" thick. It may be that where a relatively mild steel is employed, such as may have a 50 kpsi yield, a greater thickness may be selected than when a higher yield steel (70 kpsi or more) is selected. Sheet 86 may be between ⅓" as thick and the same thickness as sheet 80, and, in one embodiment may be about ½" as thick. In one embodiment sheet 80 may be about as thick as deck sheet 44.

Sheet 86 may be joined to sheet 80 at a tangent, i.e., such that there is slope continuity between sheet 80 and sheet 86, even if the mating seam is not flush but rather offset. Further, sheet 80 may continue upward on an arcuate profile, which may in some embodiments be parabolic, elliptic, or circular. When made on a circular arc, such that sheet 86 has a circular cylindrical section, and an axis of curvature parallel to the longitudinal centerline of the car, the radius of curvature may be quite large. In one embodiment it may be in the range of 250-500 inches, and may, in one embodiment, be about 400 inches (+/−10%). The center of curvature may lie at a height that is at or relatively near the height of deck sheet 44. For example, in one embodiment, the center of curvature may lie between deck sheet 44 and a height that is up to twice the height of upper portion 84 above deck sheet 44. In one embodiment, the center of curvature may lie in the range of about 75% to 125% of the height $H_1$ of the upper margin of upper portion 84 above deck sheet 44. Expressed differently, in the light car (i.e., empty) condition, the center of curvature may be located at a height that is in the range of 100% to 200% of the height $H_2$ of the deck sheet 44 (which, itself, may be at substantially the same height as the center sill top cover plate) relative to top of rail, TOR. More narrowly, this may fall in the range of 125% to 175% of $H_2$, and in one embodiment, about 150%, (+/−10%). Expressed differently again, where the height from the deck to the top chord is identified as $H_3$, the height of the center of curvature above deck 44 may be at a level of less than ⅓ of $H_3$ above deck sheet 44, and, in one embodiment, may be about ¼ of $H_3$ above deck sheet 44 (+/−10%), which may also be about the same height as $H_1$. In absolute terms, $H_1$ may be in the range of about 15 to 36 inches, and, in one embodiment may be in the range 18 to 30 inches, and, in another embodiment, may be in the range of 20-24 inches. It may be that the height of maximum width of the car may tend to lie between the height of the center of curvature and the height $H_1$ of the upper margin of upper portion 84, or, to the extent that a single sheet is used, at or near the transition from the tangent portion corresponding to upper portion 84 to an arcuate upper portion corresponding to sheet 86.

Upper sheet 86 may be formed on an inwardly tending arc, as indicated above, and may have an upper margin 90 meeting, and being joined to, top chord member 38. To that end, either top chord member 38 may be formed to conform to the curvature of upper sheet 86, generally, or upper margin 90 may include a flange or lip 92 bent to conform to a wall or wall portion of top chord member 38. For example, top chord member 38 may have the form a closed structural section, which may, for example be a square or rectangular hollow section. Lip 92 may be joined to a side web of that section in a lap joint, as indicated. It may be that top chord 38 has a joint pin/reinforcement doubler or plate 94 welded along one or both of the upper and lower surfaces thereof adjacent to the endwall junction, through which corner pin 95 seats. Corner Pin 95 passes through the hollow structural member of top chord 40 of endwall 30 or 32 as may be, and plates 94, thus forming a double shear pin joint.

The shape of the profile of sidewall member 62, be it arcuate and concave as shown, or some other shape, may tend to converge from bottom to top, such that the lateral width of accommodation 45 (i.e., the width of the tub), may tend to be wider near the floor panel, and narrower at the clearance width between the top chords. It may be that the majority of top chord member 38 lies laterally inboard of the lateral extremity, or edge of the outboard margin 46 of deck sheet 44. In one embodiment all of top chord 38 lies inboard of that edge. Expressed somewhat differently, the outer fiber of top chord member 38 may lie flush with, or laterally inboard shy of the edge 46. Expressed differently again, the width of top chord member 38 may be less than or equal to the laterally inboard cant or narrowing of wall member 62, or is less than or equal to half the overall decrease in width from the location of maximum width, $W_{Max}$, to the narrowed width $W_{35}$ at opening 35, the closure width inside top chord members 38.

Car 20 may include internal reinforcements or stiffeners 100, 102 such as may have outboard margins 104 formed to conform to, and to maintain, the profile of sidewall member 62. Stiffeners 100 may be located at longitudinal stations (i.e., cross-sectional y-z planes) substantially level with, or overlying, each of the bolsters. Stiffeners 102 may be located at longitudinal stations of, or overlying, cross-bearers. In one embodiment stiffeners 102 may overlie the next adjacent longitudinally inboard cross-bearer 106 to each of the respective bolsters.

It may be that stiffeners 102 and 100 may be aligned over vertical webs 72 of the respective cross-bearers 48 and bolsters 50, and may be co-planar therewith, such that there is web continuity above and below deck sheet 44. Taking a left hand side stiffener 102, a left hand cross-bearer 48, having a web 72, web 73 in center sill 42, a right hand cross-bearer 48 having a web 72 and a right hand side stiffener 102, it may be seen that there is a continuous web or web assembly 110. Web assembly 110 is connected to an outer flange defined by the adjacent portion of sidewall panel 62, the bottom flange 74 of the left hand cross-bearer 48, the bottom flange 75, of web 73, the bottom flange 74 of the right hand cross-bearer 48 and the adjacent portion of the other sidewall panel 62 in the zone of influence of that web. The web assembly so defined is also connected to a partial inner flange, defined by the top flange 112 of cross-bearer 48, namely that region of deck sheet 44 that is influenced by web assembly 110. For the purposes of approximation, that zone of influence may extend to a width of the order of 24 times the thickness of deck sheet 44 to either side of the web, or, in the case of the sheets of the sidewall panels, to 24 times the thickness of those sheets. More generally, it may be taken as 20-30 times thickness, to either side of the web. The resultant structure is in the nature of an inverted arch, a former, or frame, or rib, which may have something of a wishbone shape in profile. This resulting structure is, in essence, both a former, and a spring, designated as 114. The legs of the spring have a narrowing or tapering section, and terminate at tips 115 that join the top chord members 38. The spring may tend to resist deflection of the sidewalls under the lateral pressure of the lading, and may tend to resist lateral deflection of the top chords. Stiffeners 100 may interact with the webs of bolsters 50 in an analogous manner to form spring or frame assemblies.

Stiffeners 100 may be of a different profile than stiffeners 102. Bolster 50 may have a web 101, a bottom flange 103, and a top flange 105. In one embodiment top flange 105 may be defined by the adjacent portion of deck sheet 44 influenced by web 101. It may also be that car 20 is a high gross weight car that may have wheels 60 of large diameter (i.e., greater than 33 inches). Given that the height of the deck sheet may tend to correspond to the height of, and may in some embodiments form, the coupler pocket cover plate (which may, in turn be carried through as the height of that portion 107 of deck sheet 44 defining the center sill top cover plate), and given that it may be desirable to maintain a minimum clearance over the trucks, it may be that the outboard arm 109 of bolster 50 may be relieved in a region overlying the sideframes, as indicated by the relief or accommodation 116 at which a bight has been formed in web 101, and bottom flange 103 deviates upward as at 118, as seen by contrast with the inboard and outboard portions 120, 122 of bottom flange 103 that lie in a common plane, both of them lying lower than the portion at 118. In one embodiment, accommodation 116 may be in the range of ¼ to ⅔ of the depth of arm 109 outboard of the side bearing mount.

The inside margin 124 of stiffener 102 may tend to run on a more or less straight line from the top chord member to the deck sheet (with a generously radiused join 111 at the junction with the floor sheet). That straight line may run substantially vertically, or on a relatively steep incline symbolized by angle $\alpha$. The web width at the root of stiffener 102, indicated by dimension W, (which may be measured perpendicular to edge 124 at the point of tangency to radius 111, or may, alternatively, be measured from the intersection of the straight line tangent projection of edge 124 with deck sheet 44 to the junction of sheet 44 with plate 80) may tend to be at least 75% as great as the depth of cross-bearer 48, indicated as 'V'. In one embodiment W is at least as large as V, and in another embodiment W is at least 125% as large as V.

By contrast, in view of the reduction of section of bolster 50 at accommodation 116 over the truck sideframe, stiffener 100 may have a first, upper, or distal portion 126 having a straight line profile 127, which may be tapering or narrowing toward tip 115, and which may in general correspond to or match the distal portion of the profile of stiffener 102; and a second, lower, or proximal portion 128 that has a profile 129 extending more laterally inboard than that of the lower portion of stiffener 102. Profile 129 may merge into portion 126 on a relatively large radius, as at 130. Portion 128 may have a predominantly straight line profile 129 and may merge on a feathered radius 131 into deck sheet 44 at a location inboard of the side bearing 132 of truck 24, the side bearing mount region 134 on bottom flange 103, and also inboard of bolster side bearing mount reinforcement gusset 136. The slope of profile 129, indicated as $\alpha_2$, may be less steep than that of profile 127, such that $\alpha_1$ is greater than $\alpha_2$, as measured from the horizontal. It may be that portion 128 is formed such that the narrowest throat region measured between the deviated portion 118 of flange 103 and edge profile 129 of portion 128, identified by dimension 'D', is at least 75% as great as the depth of bolster 50 immediately inboard of reinforcement gusset 136, that depth tending to be the same as the depth of bolster 50 at side bearing mount 134, that depth being indicated as 'E'. In one embodiment D is at least as great as E, and in another embodiment, D is at least 25% greater than E. It may be that the slope of edge 138 of deviation 118 is less steep than angle $\alpha_2$, both being measured from the horizontal.

In some embodiments, it may be desirable for desk sheet 44 to be kept unobstructed along the centerline of the car between the inboard toes 113 of stiffeners 100 or 102, respectively. Alternatively, in one embodiment, the left and right hand pairs of stiffeners 100 or 102 may be formed as a single member having a U-shaped profile, i.e., with a back extending fully across the longitudinal centerline of car 20. The shallowest height of this central back portion (which may be at the longitudinal centerline of or car 20) may extend from deck sheet 44 to a height corresponding to the widest portion of the bulge of the sidewalls, or to the top of tangent portion 84, or the height of the center of curvature of the sidewalls, as may be. The height of this local minimum may also be less, and may be zero in some embodiments.

Running longitudinally between the generally U-shaped springs or reinforcements so defined, at each end of car 20 there are lifting, or clamping, fittings 55, as noted above. Each lifting fitting installation may include a relief or rebate, or opening, or accommodation 150 formed in the sidewall panel assembly. It may be that accommodation 150 is formed in sheet 80, and may extend from roughly the level of deck 44 upward a distance less than the width of portion 84. The corners of this accommodation may be radiused.

Within accommodation 150, there may be a grip member 152, which, in one embodiment, may have the form of a channel welded toes down at the margin of deck sheet 44, grip member 152 extending the width of accommodation 150. Accommodation 150 may be enclosed internally by a backwall, or backshell member 154, which may have the form of a bent plate extending longitudinally between stiffener 100 and stiffener 102, and between deck sheet 44 and sidewall panel 62 to form an enclosed pocket. The fillet welded junction of member 154 to deck sheet 44 may be protected by a shroud member 156, which may have a curved form.

As noted above, it may be that clearance space over wheels 60 is limited. In that light, car 20 may include cut-outs or reliefs 160 formed in deck sheet 44 at the locations customarily located over wheels 60. Car 20 may further include blisters, or aperture covers 162, 164 such as may allow additional clearance over reliefs 160, while maintaining the integrity of the containment structure in a manner tending to discourage leakage of lading. In one embodiment covers 162 may have the form of channel members extending cross-wise across the car with toes oriented downward and welded to deck sheet 44 in a manner covering, or staddling, or overspanning, reliefs 160. In such an embodiment, the cross-wise extending channels also define floor stiffeners or reinforcements for the car body deck sheet 44 more generally, where the reinforcements are located above the level of the deck sheet, rather than below.

Car 20 may include a number of cross-bearers, 168, with which no internal stiffener of the nature of stiffeners 100 or 102 is associated. It may be noted that there may be no external sidewalls or side beam stiffener associated with cross-bearers 168, either. Rather, the curved form of sidewall panels 62, to which panels 62 are forced to conform by the outer profile 104 of stiffeners 100 and 102, and reinforced by the top flange function performed by top chord member 38 and by the bottom flange function performed by the interaction of sidewall panel 62 and deck sheet 44, may define a deep beam to resist vertical bending. The outboard ends of cross-bearers 168 terminate at that deep beam. The elimination of outboard posts at the longitudinal stations of cross-bearers 168 may tend to permit an increase in internal volume of car 20, and may in some instances tend to permit an overall reduction in car weight.

In the mid span region 170 of car 20, i.e., that generally longitudinally central region lying between the fore and aft pairs of stiffeners 102, where car 20 may be free of external posts, car 20 may have a longitudinally running external top chord reinforcement 172, rather than a top chord underside doubler. Reinforcement 172 may have the form of a plate extending downward and inward from the outer web of top chord member 38 to the upper region of sidewall panel 62. It may be that top chord member 38, and the adjacent structure to which it is attached have a second moment of area for resisting vertical bending, and a second moment of area for resisting lateral deflection. Reinforcement 172 may increase both second moments of area, but may, proportionately, increase the effective second moment of area of the top chord assembly in the lateral direction proportionately more than the vertical second moment of area as compare, for example, to the adjacent sections of top chord member 38 longitudinally outboard of stiffeners 102 where there is no additional top chord reinforcement. Expressed somewhat differently, the top chord assembly has a central portion that is locally reinforced to provide a higher measure of resistance to lateral deflection of the top chord. While that additional member may also somewhat increase the local resistance to vertical bending, the effect is proportionately greater with respect to lateral deflection than vertical deflection. In one embodiment, the increase in the local second moment of area may be of the order of 20% to 100%.

Figure 1J:
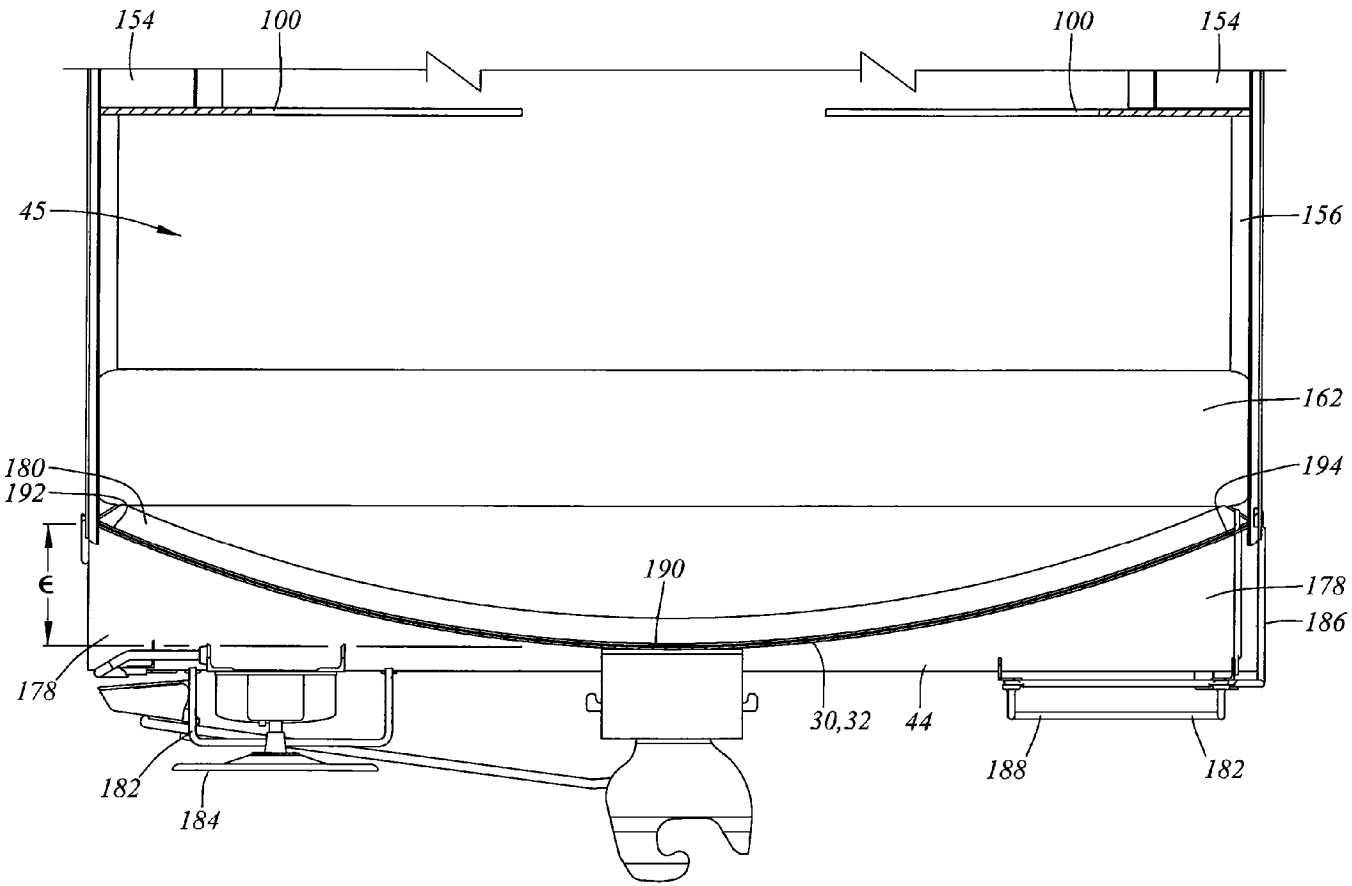
FIG. 1*j* is a cross-section taken on sections 1*j*-1*j* of FIG. 1*e* looking downward through end.
Figure 1K:
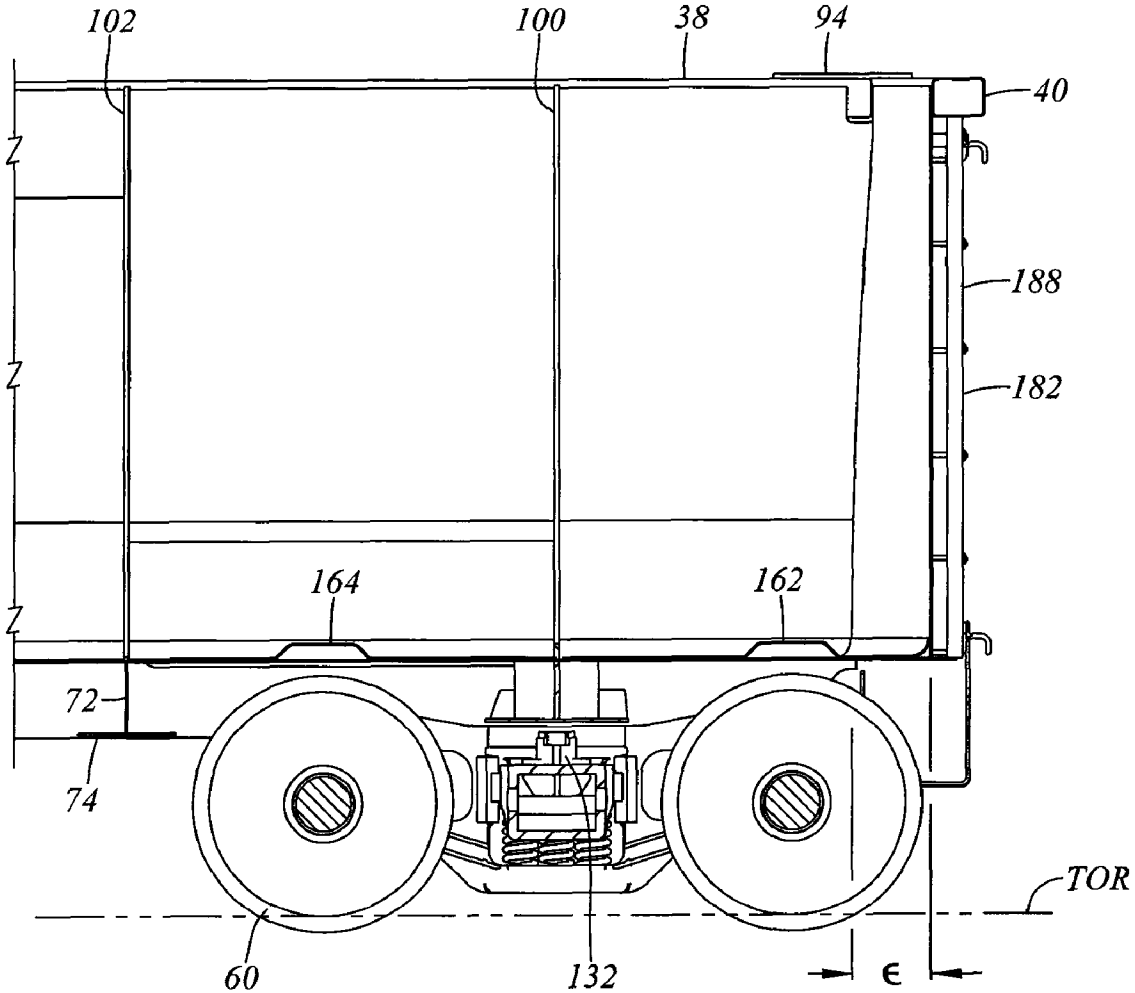
FIG. 1*k* is a cross-section taken on section 1*k*-1*k* of FIG. 1*e* looking toward side of car.

Endwalls 30 and 32 of car 20 may employ arcuate endwall members 180. Endwall members 180 may be formed sheets, and may be free of lateral reinforcements. That is, a known endwall design relies upon a substantially planar endwall sheet, with outside stiffeners in the nature of an array of vertically spaced, horizontally extending channel reinforcements welded on the outside. By contrast, endwall members 180 may include endwall sheets that have been formed on a bulging profile, which may be concave, and which may be arcuate. The arcuate profile may be parabolic, or elliptic, or catenary. From above, the arc may appear similar to the curve of an old style bathtub particularly as where the tangent profile of the sheet is slightly inclined. In one embodiment it may be formed on a portion of a circular arc of constant radius, and is arched only about a vertical axis, such that the profile is cylindrical, as opposed to a spherical or other compound curvature. It could be formed on a pair (or more) of radii with linking tangent or arcs. In any case, endwall members 180 may function as a restraining membrane, with an upper margin reinforced by top chord member 40, a lower margin restrained by deck sheet 44, and edges restrained at sidewall panels 62. It may be that, as seen from above, deck sheet 44 extends proud of the side margin regions of endwall members 180, such as to leave a roughly triangular end portion 178 of deck sheet 44 exposed outside of the lading carrying tub (i.e. accommodation 45). This triangular region may provide space for a safety appliance installation 182, such as for a handbrake 184, or for side or end access ladders 186, 188. That is to the extent that endwall members 180 have a central portion 190 and lateral edge portions 192, 194, and to the extent that central portion 190 extends further longitudinally than edge portions 192, 194, the distance of that protrusion leaves or augments the space available in which to mount the safety appliances. Expressed somewhat differently, the longitudinal difference in station between the center of member 180 on the car centerline, and the corners at the junction with the side panels, at deck level, indicated on FIG. 1*j* as $\epsilon$ may be more than half the width of access ladder 186, and in one embodiment may be in the range of 2/3 to 4/3 that width. Alternately expressed the ratio $\epsilon/W_{Max}$ may be in the range of 2/3 to 4/3 that width. Alternately expressed, the ratio $\epsilon/W_{Max}$ may lie in the range of 1/12 to 1/8, and in one embodiment may be about 1/10 (+/−10%).

Various embodiments have been described in detail. Since changes in and or additions to the above-described examples may be made without departing from the nature, spirit or scope of the invention, the invention is not to be limited to those details.

I claim:

1. A rail road gondola car having a lading containment structure mounted upon rail road car trucks for rolling motion along rail road car tracks;

said lading containment structure including a bottom portion defining a deck and upstanding sidewall portions running lengthwise along side margins of said deck;

said sidewall portions having a lower margin adjoining said deck, and an upper margin distant from said deck, said upper margin terminating at a top chord;

each said sidewall portion having an height measured upwardly of said deck;

each truck having a truck bolster extending cross-wise between a pair of sideframes, and wheelsets mounted in the sideframes;

each wheelset having an axle and a pair of first and second wheels mounted at either end thereof;

said deck having at least one body bolster mounted cross-wise thereunder, said at least one body bolster being pivotally mounted on a respective truck bolster of one of said trucks;

said containment structure having a sidewall reinforcement extending partially cross-wise therewithin abreast of one of said at least one body bolster, said sidewall reinforcement extending laterally inboard of one of said wheels of said truck;

said sidewall reinforcement having a region mated to a respective one of said sidewall portions, said reinforcement extending upwardly against said respective one of said sidewall portions a height greater than ¼ of said height of said sidewall portion, and said reinforcement standing less far upwardly of said deck inboard of said respective sidewall portion.

2. The rail road gondola car of claim 1 wherein said upstanding sidewall portions of said rail road gondola car include portions having an arcuate profile when viewed in cross-section, said sidewall portions having clamp fittings, said clamp fittings permitting said rail road gondola car to be inverted for dumping of lading from said rail road gondola car.

3. The rail road gondola car of claim 1 wherein said sidewall portions include curved sidewalls having a center of curvature laterally inboard thereof, said deck is a predominantly flat floor extending substantially end-to-end and side-to-side of said rail road gondola car, there are cross-bearers supporting at least a portion of said predominantly flat floor; and said rail road gondola car is free of upwardly extending posts abreast of at least one of said cross-bearers.

4. The rail road gondola car of claim 3 wherein a majority of said cross-bearers are mounted at longitudinal stations of said rail road gondola car that are free of upstanding sidewall reinforcement posts.

5. The rail road gondola car of claim 3 wherein said rail road gondola car is free of external sidewall support posts abreast of said cross-bearers.

6. The rail road gondola car of claim 1, wherein said bolsters are mounted cross-wise above said trucks and beneath said deck, and there is an upstanding web above said deck, said upstanding web running lengthwise centrally along at least one of said bolsters above said deck, and said sidewall reinforcement includes said upstanding web.

7. The rail road gondola car of claim 6 wherein said containment structure includes a peripheral wall, and a wall reinforcement web mounted in alignment with said central upstanding web of said bolster.

8. The rail road gondola car of claim 6 wherein said containment structure includes a peripheral wall, said peripheral wall includes sidewalls, and at least one of said sidewalls has a profile, when viewed in cross-section, that is arcuate.

9. The rail road gondola car of claim 1 wherein said deck has bolsters and cross-bearers extending cross-wise thereunder; said sidewall portions having an inwardly concave portion, and said deck defines both (a) an upper flange of said cross-bearers and said bolsters, and (b) a predominantly horizontally extending bottom flange of said sidewall portions.

10. The rail road gondola car of claim 9 wherein said car further includes a lengthwise running center sill, and said deck forms a top cover of said center sill.

11. The rail road gondola car of claim 9 wherein said containment structure includes cross-wise extending reinforcement members mounted to said deck at lengthwise intermediate locations, said cross-wise reinforcement members being mounted upon said deck.

12. The rail road gondola car of claim 11 wherein said reinforcement members are channels, and said deck has accommodations formed therein beneath said reinforcement members, said accommodations being formed at locations above said wheels of said trucks.

13. The rail road gondola car of claim 1 wherein said sidewall reinforcement is substantially triangular when viewed in the lengthwise direction of said car.

14. An open topped rail road gondola car comprising:

a bottom portion;

a pair of first and second lengthwise running sidewalls;

a pair of first and second cross-wise extending endwalls;

said bottom portion, said first and second lengthwise running sidewalls, and said first and second cross-wise running endwalls co-operating to define an open topped containment structure into which lading may be introduced, the containment structure being carried by rail road car trucks;

each of said first and second lengthwise running sidewalls and said first and second cross-wise extending endwalls having an upper margin distant from said bottom portion, and a respective top chord portion running along said upper margin;

said upper margins of said sidewalls and said endwalls co-operating to define a periphery of an opening of said containment structure;

said sidewalls having sidewall sheets mounted to follow an outwardly bulging, inwardly concave shape;

reinforcements of said sidewalls mounted laterally inboard thereof, said reinforcements being formed to conform to said inwardly concave shape; and said sidewalls having a lower portion meeting said bottom portion at a junction, and an upper portion upwardly distant from said bottom portion, said upper portion having an upper margin more laterally inboard than said junction; and said bottom portion of said containment structure includes a substantially flat deck running end-to-end lengthwise along said car, and said lower portion of each said sidewall mates with said deck, and, when so mated, each said sidewall functions as a deep beam for which said deck performs a bottom flange function and the respective top chord portion performs a top flange function.

15. The open topped rail road gondola car of claim 14 wherein said rail road car is a rotary dump gondola car.

16. The open topped rail road gondola car of claim 14 wherein said first sidewall has a location of maximum car width at a height H1, and said first sidewall has an overall height H2 measured upwardly from said deck, and H1 is less than one third of H2.

17. The open topped rail road gondola car of claim 14 wherein said first sidewall has an arcuate portion that is increasingly inwardly angled as a function of upward height from the bottom portion.

18. The open topped rail road gondola car of claim 17 wherein said arcuate portion forms the majority of said first sidewall.

19. The open topped rail road gondola car of claim 17 wherein said first sidewall has a lower margin and has a thickened member running along said lower margin.

20. An open topped rail road gondola car comprising:

a bottom portion;

a pair of first and second lengthwise running sidewalls;

a pair of first and second cross-wise extending endwalls;

said bottom portion, said first and second lengthwise running sidewalls, and said first and second cross-wise running endwalls co-operating to define an open topped containment structure into which lading may be introduced, the containment structure being carried by rail road car trucks;

each of said first and second lengthwise running sidewalls and said first and second cross-wise extending endwalls having an upper margin distant from said bottom portion, and a respective top chord portion running along said upper margin;

said upper margins of said sidewalls and said endwalls co-operating to define a periphery of an opening of said containment structure;

said sidewalls having sidewall sheets mounted to follow an outwardly bulging, inwardly concave shape;

reinforcements of said sidewalls mounted laterally inboard thereof, said reinforcements being formed to conform to said inwardly concave shape; and said sidewalls having a lower portion meeting said bottom portion at a junction, and an upper portion upwardly distant from said bottom portion, said upper portion having an upper margin more laterally inboard than said junction; and said bottom portion of said rail road car is a deck plate, and said lower portion of said sidewalls mates with said deck plate at an angle lying in the range of 75 degrees to 90 degrees.

21. The open topped rail road gondola car of claim 20 wherein said angle lies in the range of 80 to 90 degrees.

22. The open topped rail road gondola car of claim 20 wherein the angle lies in the range of 85 to 90 degrees.

23. An open topped rail road gondola car comprising:

a bottom portion;

a pair of first and second lengthwise running sidewalls;

a pair of first and second cross-wise extending endwalls;

said bottom portion, said first and second lengthwise running sidewalls, and said first and second cross-wise running endwalls co-operating to define an open topped containment structure into which lading may be introduced, the containment structure being carried by rail road car trucks;

each of said first and second lengthwise running sidewalls and said first and second cross-wise extending endwalls having an upper margin distant from said bottom portion, and a respective top chord portion running along said upper margin;

said upper margins of said sidewalls and said endwalls co-operating to define a periphery of an opening of said containment structure;

said sidewalls having sidewall sheets mounted to follow an outwardly bulging, inwardly concave shape;

reinforcements of said sidewalls mounted laterally inboard thereof, said reinforcements being formed to conform to said inwardly concave shape; and said sidewalls having a lower portion meeting said bottom portion at a junction, and an upper portion upwardly distant from said bottom portion, said upper portion having an upper margin more laterally inboard than said junction;

said first sidewall is part of a convergent wall section, said wall section tending generally to narrow from a wider base to a narrower upper margin, said first sidewall has an arcuate portion, and said first sidewall is formed on a curve, said curve has substantially smooth slope continuity from said wider base to said narrower upper margin thereof, and said curve is more nearly perpendicular to said bottom portion at said junction than at said narrower upper margin.

24. The open topped rail road gondola car of claim 23 wherein said wall section has a maximum car width at said bottom portion, and narrows progressively toward said narrower upper margin.

25. The open topped rail road gondola car of claim 24 wherein said respective top chord portion of said first sidewall extends along said upper margin of said first sidewall, said respective top chord portion is located outboard of said upper margin, and said top chord portion extends laterally outboard a distance D corresponding substantially to that of said first sidewall at said junction.

26. The rail road gondola car of claim 25 wherein D lies at most equally as far laterally outboard as said first sidewall at said junction.

27. An open topped rail road gondola car comprising:

a bottom portion;

a pair of first and second lengthwise running sidewalls;

a pair of first and second cross-wise extending endwalls;

said bottom portion, said first and second lengthwise running sidewalls, and said first and second cross-wise running endwalls co-operating to define an open topped containment structure into which lading may be introduced, the containment structure being carried by rail road car trucks;

each of said first and second lengthwise running sidewalls and said first and second cross-wise extending endwalls having an upper margin distant from said bottom portion, and a respective top chord portion running along said upper margin;

said upper margins of said sidewalls and said endwalls co-operating to define a periphery of an opening of said containment structure;

said sidewalls having sidewall sheets mounted to follow an outwardly bulging, inwardly concave shape;

reinforcements of said sidewalls mounted laterally inboard thereof, said reinforcements being formed to conform to said inwardly concave shape; and said sidewalls having a lower portion meeting said bottom portion at a junction, and an upper portion upwardly distant from said bottom portion, said upper portion having an upper margin more laterally inboard than said junction; and each said sidewall has its widest point at its lower margin.

28. An open topped rail road gondola car comprising:

a bottom portion;

a pair of first and second lengthwise running sidewalls;

a pair of first and second cross-wise extending endwalls;

said bottom portion, said first and second lengthwise running sidewalls, and said first and second cross-wise running endwalls co-operating to define an open topped containment structure into which lading may be introduced, the containment structure being carried by rail road car trucks;

each of said first and second lengthwise running sidewalls and said first and second cross-wise extending endwalls having an upper margin distant from said bottom portion, and a respective top chord portion running along said upper margin;

said upper margins of said sidewalls and said endwalls co-operating to define a periphery of an opening of said containment structure;

said sidewalls having sidewall sheets mounted to follow an outwardly bulging, inwardly concave shape;

reinforcements of said sidewalls mounted laterally inboard thereof, said reinforcements being formed to conform to said inwardly concave shape; and said sidewalls having a lower portion meeting said bottom portion at a junction, and an upper portion upwardly distant from said bottom portion, said upper portion having an upper margin more laterally inboard than said junction; and said cross-wise extending endwalls include curved endwall members.

29. The open topped rail road gondola car of claim 28 wherein at least one of said endwalls is formed on a cylindrical section having a vertical axis.

30. The open topped rail road gondola car of claim 28 wherein said first sidewall and at least one of said curved endwall members intersect at a common locus of intersection.

31. The open topped rail road gondola car of claim 28 wherein at least one of said sidewall top chord portions and at least one of said endwall top chord portions are joined at a pin-jointed connection.

32. The open topped rail road gondola car of claim 28 wherein said bottom portion of said containment structure has a floor plate; said floor plate extends longitudinally proud of at least a portion of one of said endwall members in a transversely outboard region thereof.

33. The open topped rail road gondola car of claim 28 wherein said lengthwise running sidewalls and said cross-wise running end walls co-operate to define an upstanding peripheral wall of said containment structure, said floor plate extends proud of said peripheral wall, and a ladder is mounted to a corner region of said floor plate lying outboard of said peripheral wall.

* * * * *